US005991991A

United States Patent [19]

Pleschiutschnigg

[11] Patent Number: 5,991,991

[45] Date of Patent: Nov. 30, 1999

[54] HIGH-SPEED THIN-SLABBING PLANT

[75] Inventor: Fritz-Peter Pleschiutschnigg, Duisburg, Germany

[73] Assignee: Mannesmann Aktiengesellschaft, Düsseldorf, Germany

[21] Appl. No.: 09/011,354

[22] PCT Filed: Jul. 19, 1996

[86] PCT No.: PCT/DE96/01378

§ 371 Date: Apr. 1, 1998

§ 102(e) Date: Apr. 1, 1998

[87] PCT Pub. No.: WO97/05971

PCT Pub. Date: Feb. 20, 1997

[30] Foreign Application Priority Data

Jul. 31, 1995 [DE] Germany ..... 195 29 049

[51] Int. Cl.[6] ..... B23B 23/04; B21B 1/26

[52] U.S. Cl. ..... 29/33 C; 72/202

[58] Field of Search ..... 29/33 C, 527.7; 164/432, 263, 418; 72/202, 229, 240

[56] References Cited

U.S. PATENT DOCUMENTS 5,329,688 7/1994 Arvedi et al. ..... 29/527.7

5,542,165 8/1996 Coassin et al. ..... 29/33 C 5,634,510 6/1997 Hirano et al. ..... 29/33 C X

*Primary Examiner*—William Briggs

*Attorney, Agent, or Firm*—Cohen, Pontani, Lieberman & Pavane

[57] ABSTRACT

A machine for producing hot-rolled steel strip from input stock of continuously cast strip in sequential work steps. The input stock is thereby in a continuous casting machine with a cast-rolling device at a casting speed of 4 to 8 m/min and a solidification thickness of 90 to 125 mm. An oscillating continuous casting mold is used, which has concavity between the casting level and the mold exit. A strand guide device has concavity and/or centering and guiding elements to guide and center the slab in the area of its narrow sides in the strand guide stand. A cooling and insulating line is located between the continuous casting machine and the equalizing furnace for the strip-type input stock. Furthermore, a cross-transfer furnace 45 m in length and approximately 5 to 20 m wide is arranged after the continuous casting machine and in front of the roughing train.

4 Claims, 2 Drawing Sheets

Fig. 2

TEMPERATURE LOSS VIA RADIATION

| Strand Thickness in mm | Degrees C/sec | ./.Slab temperature at exit of continuous casting machine in °C | Furnace entrance temperature in °C | Temperature difference between continuous casting machine and furnace in °C | Holding time between continuous casting machine and furnace entrance | |
|---|---|---|---|---|---|---|
| | | | | | | |
| 125 | 0,3 | 1325 | 1200 | 125 | 417 | 6,95 |
| | | | | | | |
| 100 | 1 | 1325 | 1200 | 125 | 125 | 2,08 |
| | | | | | | |
| 90 | 1,26 | 1325 | 1200 | 125 | 99 | 1,65 |
| | | | | | | |

HIGH-SPEED THIN-SLABBING PLANT

BACKGROUND OF THE INVENTION

1. Field of the Invention

The invention relates to a machine for producing hot-rolled steel strip from input stock of continuously cast strip in sequential work steps, in which the solidified input stock is divided by means of a strip dividing machine into initial strip lengths and, after the descaling of its surface, is brought to a homogeneous rolling temperature in an equalizing furnace, roughed in at least two roll passes in a first roll stand that serves as a roughing train and, after being stored in coiling and uncoiling stations arranged in front of the finishing train, fed, after descaling, to the finishing train to be rolled to finished strip thickness.

2. Discussion of the Prior Art

Such a machine is described in German reference DE 195 12 953.9, which has not previously been published.

The previously known machines on the market for producing hot strip from thin slabs need or needed at least two continuous casting machines to achieve a capacity equilibrium, relative to the continuous hot rolling mill, of approximately 2 to 2.5 mio tpa and thus to maximize productivity.

These continuous casting machines operate at a casting speed of 5 to 6 m/min with good operational reliability and, given a casting level thickness of 50 to 80 mm, have a solidification thickness of 60 to 43 mm.

In contrast, classic continuous casting machines with a size of 1600×200 mm, for example, can cast at a maximum of 2 m/min. In practical operation, average casting speeds of 1.6 to 1.8 m/min are recorded, because at higher speeds casting reliability is endangered by the risk of breakthrough.

SUMMARY OF THE INVENTION

The object of the present invention is to provide a high speed thin slabbing plant having the continuous casting stage and the rolling stage, and which combines minimum investment costs and minimum conversion costs with maximum productivity, while simultaneously attaining strip thicknesses to 1 mm or, in initial approximation, capacity equilibrium relative to the continuous finishing train.

This is achieved with minimum rolling expense by ensuring a process that requires no supply of sensible heat from outside and needs only minimum investment. Surprisingly, such a solution was found by combining the following features:

A continuous casting machine with a cast-rolling device for producing the strip-type input stock at a casting speed of 4 to 8 m/min and a solidification thickness of 90 to 125 mm, using an oscillating, hydraulically driven continuous casting mold, which has concavity between the casting level and the mold exit, and/or a strand guide device, which has concavity and/or centering and guide elements to center and guide the strand in the area of its narrow sides in the strand guide stand. A cooling and insulating line is located between the continuous casting machine and the equalizing furnace for the strip-type input stock. A cross-transfer furnace approximately 45 m in length and approximately 5 to 20 m in width, is located downstream from the strand dividing machine and upstream from the roughing train.

The invention, makes it possible to achieve minimum rolling expense and a minimum hot strip thickness of 1.0 to 0.8 mm with a single continuous casting machine, while attaining total capacity utilization of a rolling mill with a capacity of 2 to 2.5 mio tpa.

Further, this solution is characterized by the fact that the slabs can be introduced into the equalizing furnace (cross-transfer furnace) with an adequate heat content. The furnace is then responsible only for equalizing the temperature of the slab and, if necessary, permitting the slabs to be stored between the continuous casting stage and the rolling stage.

Because of production disruptions or for material-technical reasons, a buffering (holding time) of the slabs in the furnace can be necessary and can influence the internal structure (e.g., grain formation).

Accordingly, the furnace is operated in an energy-neutral fashion. The only energy that must be supplied to the furnace is what it loses via its radiant losses (e.g., 0.5 $KW/m^2$). This energy can be supplied by means of burners as well as by a higher slab heat content, as needed for rolling. In the latter case, for example, the furnace also functions as a type of cooling aggregate.

To allow the slab to enter the furnace with the desired energy content, so that the furnace functions only as a equalizing furnace, cooling and insulation means should be provided between the continuous casting machine and the furnace entrance. The heat content of the slab can be influenced by a spray cooling device and/or a controlled coverable roll table or an intermediate buffer.

After the slab leaves the furnace, the slab is rolled in two passes on a tandem roughing mill or in three passes on a singlestand reversing roughing mill to 25 to 10 mm. After intermediate cooling, the slab is then finish rolled in a four-stand or five-stand finishing train into hot strip of a minimum of 0.8 to 1.0 mm.

The invention offers high operational reliability, because the strip, relative to a thin slab with a thickness in the mold of, e.g., 50 mm, has a slag availability that is 2 to 6 times higher. This results in a correspondingly lower heat transmission and a lower thermal load of both the strand shell and the mold plates.

The concave shape of the mold broad sides and/or of the strand guide device, and/or the elements that laterally guide and center the slab via its narrow sides in the strand guide device, permits a straight run of the strip, which ensures casting reliability, especially in the area of the mold, at a higher casting speed of 4 to 8 m/min.

Further, the described invention provides the advantage of thicker flux film formation between the strand shell and the mold wall, which makes it easier to cast crack-sensitive steels.

BRIEF DESCRIPTION OF THE DRAWINGS

An example of the invention is shown schematically in the drawings and described below. The drawings show:

FIG. 2 In tabular form: holding times for slabs of different thicknesses between the continuous casting machine and the furnace entrance.

DETAILED DESCRIPTION OF THE PREFERRED EMBODIMENTS

Figure 1:
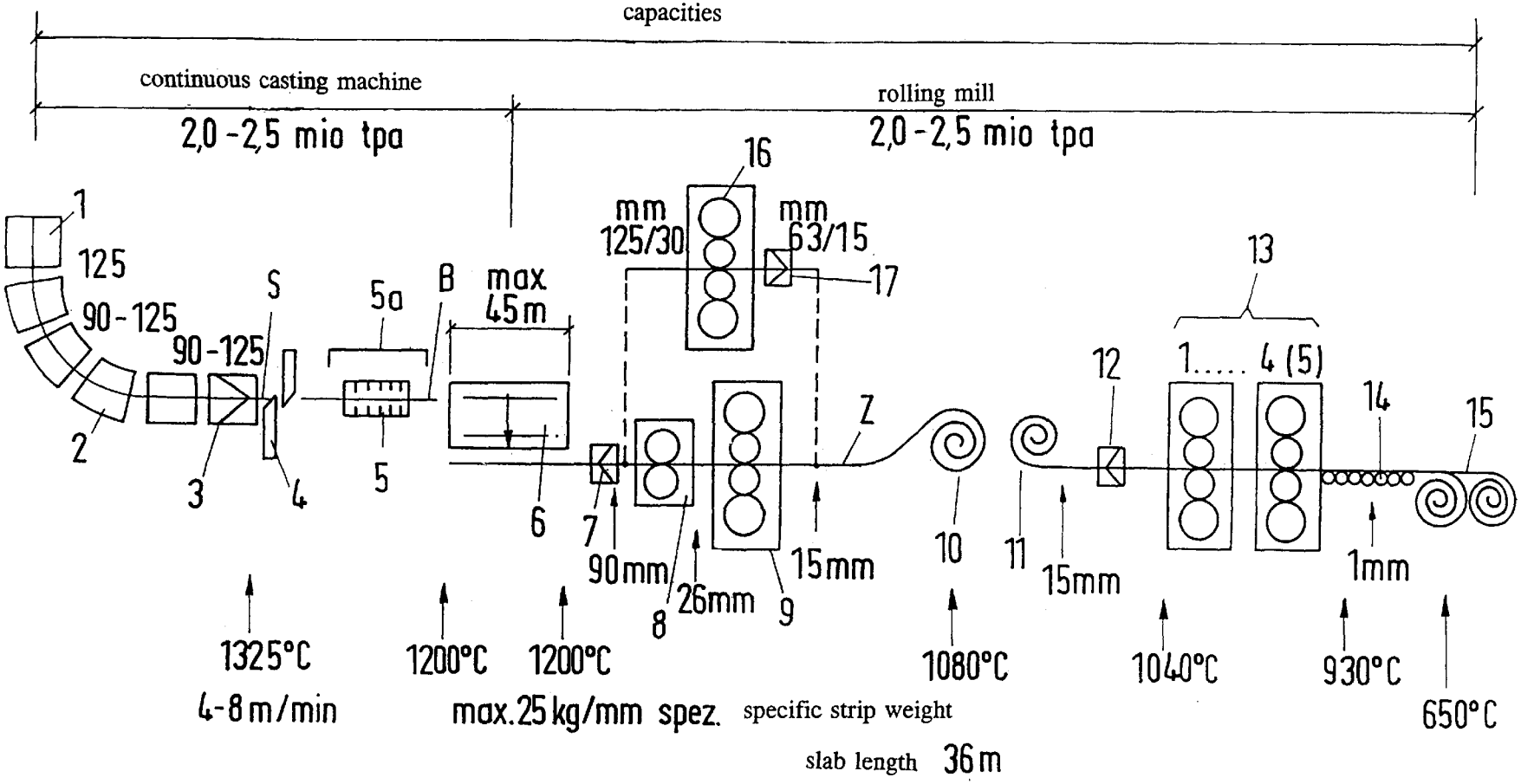
FIG. 1 A process line according to the invention.

FIG. 1, the parts are connected in sequence and identified as follows:

1 continuous casting mold

2 tongs stand

3 lowest point of liquid pool of solidifying strand

4 crosscutting device

5 cooling line

5*a* roll table cover
6 equalizing furnace
7 descaling device
8 two-high rougher
9 four-high rougher
10 coiling station
11 uncoiling station
12 descaling device
13 finishing train
14 run-out roll table
15 coiling reel
16 reversing roll stand
17 descaling device With only one continuous casting machine, the required annual capacity of 2 to 2.5 mio tpa is covered. This continuous casting machine is characterized by the strand casting mold 1, which has a thickness of 140 to 90 mm and a concavity per broad side of between 30 and 3 mm, and the tongs segment 2 for reducing the strand thickness to a minimum of 90 mm, and/or strand guiding and centering with the help of concave roller profiles in the strand guide device and/or lateral elements. The strand having a solidification thickness of 90 to 125 mm.

This continuous casting machine can be operated at a casting speed between 4 and 8 m/min without significant casting disruptions. The strand S emerging from the casting machine can, after the establishment of the heat content needed for the subsequent required rolling process, be introduced into the temperature equalizing furnace 6, which can also serve as a buffer. This temperature equalizing furnace 6 is of such a length (max. 45 m) that a specific strip weight of a maximum of 25 kg/mm can be produced. After temperature equalization, the slab B enters either the tandem rougher 8, 9 (at strand thicknesses<90 mm) or, in a different layout, the reversing stand 16 (at strand thicknesses<125 mm). In both cases, the slab B is rolled to an intermediate thickness of 15 mm. This intermediate thickness is achieved either with the tandem rougher 8, 9 in two passes or with the single-stand reversing stand 16 in three passes.

After leaving the roughing train 16 or 8, 9, the intermediate strip Z of, e.g., 15 mm is intermeidately coiled and fed to the four-stand or five-stand finishing train 13 with the downstream descaling device 12. The strip Z enters the first stand of the finishing train 13 at an entry speed of, for example, 0.8 m/sec, which makes the new formation of scale impossible, and leaves the fifth stand of the finishing train 13 with a thickness of 1 mm and an exit speed of 12 m/sec. On the run-out roll table 14 with minimum roller space of 100 mm, the strip runs through a strip cooling device, as needed, and is coiled up at approximately 650+ C. by the coiling reel 15.

The run-out roll table 14 is characterized by especially small rollers and thus roll distances that guide the thin strips well and avoid lifting the strip. Alternatively, a reel arranged shortly after the final finishing stand (5 to 15 mm) with the downstream strip cooling device is also possible here.

The thin hot strips produced in this manner can replace a large portion of the cold rolled strips on the market, and thus permit great cost and energy advantages compared with normal production lines.

FIG. 2 shows, in tabular form, the holding times for the slabs B of different thicknesses between the strand casting machine 1, 2 and the entry of the equalizing furnace 6 that are needed to ensure that, upon its entry into the equalizing furnace 6, the slab B has, via radiation, the heat content necessary for the rolling stage.

This maximum holding time can be shortened by means of a water cooling device 5 or, in the case of low continuous casting speeds of 4 m/min, for example, can be lengthened by a roll table covering 5*a*.

Advantages of the invention for producing hot strip are:

minimum investment volume due to only a single high-speed continuous casting machine, whose capacity is balanced with that of the rolling mill, as a result of which minimum conversion costs and thinnest strip thicknesses, which also substitute for part of the cold strip production range, are attained with lower energy consumption and lower total conversion costs.

In addition, the design of the continuous casting machine pursuant to the present invention makes it possible to cast peritectic steels (0.08 to 0.15% by weight C) in a crack-free manner even at high casting speeds. Based on studies, it can be assumed that at maximum heat transmission of 1.9 $MW/m^2$, for example, no longitudinal cracks will occur in the mold. Taking this as a basis, and using the criteria indicated below, no longitudinal cracks would occur in the mold.

A 100 mm strand thickness in mold 6 mr/min maximum casting speed approximately 300 t/h or 2.1 mio tpa mold thickness=solidification thickness or B 75 mm strand thickness in mold 4.5 m/min maximum casting speed approximately 150 t/h or 1.05 mio tpa mold thickness=solidification thickness or C 50 mm strand thickness in mold 2.7 m/min maximum casting speed approximately 50 t/h or 0.35 mio tpa mold [thickness]=solidification thickness Based on casting output, Machines A and B can therefore be discussed. In Case A, one machine suffices for full capacity utilization of a finishing train with approximately 2.5 mio tpa. In Case B, two machines are needed to utilize the capacity of the finishing train.

If the aforementioned heat transmission of 1.9 $MW/m^2$ is not exceeded, an average skin temperature of 550° K. or 277° C. of the copper plate in the mold and a maximum durability of approximately 770 melts or hours can be expected.

Combining the different possible machine designs described above, and assuming that below a heat transmission of 19 $MW/m^2$, crack-free casting of peritectic steels is possible, a thin slab thickness between 100 and 75 mm would permit thin slabs of peritectic steel to be cast free of longitudinal cracks at casting speeds up to 6 or 4.5 m/min.

What is claimed is:

1. A machine for producing hot-rolled steel strip from input stock of continuously cast strip in sequential work steps, comprising:

means for dividing the solidified input stock into initial strip lengths;

first means for descaling the surface of the strip lengths;

an equalizing furnace arranged downstream of the descaling means, for heating the strip to a rolling temperature;

a roughing train having at least two roll passes arranged downstream of the equalizing furnace for roughing the heated strip;

coiling and uncoiling stations arranged downstream of the roughing train for intermediately storing the strip;

a second, downstream descaling means for descaling the strip leaving the uncoiling stations;

a finishing train arranged downstream of the second descaling means for rolling the strip to a finished strip thickness;

a continuous casting machine including a cast-rolling device for producing the strip from the input stock at a continuous casting speed of 4 to 8 m/min and a solidification thickness of 90 to 125 mm, the casting machine further including an oscillating continuous casting mold which has at least one of a concavity between a casting level and a mold exit, and a strand guide stand, which has at least one of a concavity and centering and guiding elements in the strand guide strand for guiding and centering the strand in an area of its narrow sides; and a cooling and insulating line provided between the continuous casting machine and the equalizing furnace, the equalizing furnace having a length of approximately 45 m. a width of approximately 5 to 20 m. and being arranged downstream of the dividing means and upstream of the roughing train.

2. A machine for producing hot-rolled steel strip from input stock of continuously cast strip as defined in claim 1, wherein the continuous casting mold is configured to have a broad side distance of 140 to 90 mm and a concavity per broad side between the casting level and the mold exit of between 30 and 3 mm, the strand guide stand being configured to reduce the input stock to a minimum of 90 mm.

3. A machine for producing hot-rolled steel strip from input stock of continuously cast strip as defined in claim 1, wherein the roughing train is configured as a two-strand tandem roughing train.

4. A machine for producing hot-rolled steel strip from input stock of continuously cast strip as defined in claim 1, wherein the roughing train is configured as a reserving train.

* * * * *